United States Patent [19]

Braverman

[11] 4,013,252

[45] Mar. 22, 1977

[54] HANGER BRACKET FOR MERCHANDISE

[75] Inventor: Leslie Braverman, Spring Valley, N.Y.

[73] Assignee: Solo Products Corporation, Englewood, N.J.

[22] Filed: Dec. 15, 1975

[21] Appl. No.: 641,104

[52] U.S. Cl. ..... 248/220.4; 211/59.1

[51] Int. Cl.[2] ..... A47F 5/00

[58] Field of Search ..... 248/223, 225, DIG. 3; 211/59, 54

[56] References Cited

UNITED STATES PATENTS

| | | | |
|---|---|---|---|
| 1,341,198 | 5/1920 | Ruple | 248/223 X |
| 3,483,995 | 12/1969 | Larson | 248/DIG. 3 X |
| 3,645,485 | 2/1972 | Gold | 248/DIG. 3 X |
| 3,696,937 | 10/1972 | Braverman | 211/54 |

*Primary Examiner*—J. Franklin Foss
*Attorney, Agent, or Firm*—Howard C. Miskin

[57] ABSTRACT

A hanger bracket for dispensing packaged products and mountable on a perforated board is an integral unit formed of metal rod and includes a longitudinal main body portion, an upwardly directed front leg portion which is transversely flattened and an upwardly directed rear leg portion which is medially slit to a point short of the main body portion. The split rear leg sections are shaped to provide transversely radially projecting inner arms forming rearwardly projecting transversely spaced parallel arms which terminate in transversely spaced upwardly directed parallel coupling legs. In fabricating the bracket unit a pre-cut length of rod has its rear portion partially longitudinal slit. The rear and front portions of the rod are bent upwardly to form long and short legs, the split sections of the rear leg being bent to form outwardly projecting inner arms joining rearwardly projecting medial arms which terminate in upwardly projecting coupling legs.

6 Claims, 8 Drawing Figures

HANGER BRACKET FOR MERCHANDISE

BACKGROUND OF THE INVENTION

The present invention relates generally to improvements in article support and dispensing devices and it relates more particularly to an improved perforated board mountable pre-packaged article support and dispensing bracket including inventory control and to a method of producing such bracket.

It is a common practice in the vending and dispensing of a small product to pre-package the product in a small frangible transparent package, such as a transparent plastic envelope or blister container, and to support a group of the packaged articles by a bracket rod which slideably engages eyelets or openings formed in the upper borders of the packages. A large number of the bracket rods are generally separably mounted on a suitably supported regularly apertured or perforated board such as a pegboard and each rod carries a group of corresponding packages basically different from those carried by the other bracket rods.

A difficulty arises in reordering the merchandise mounted on such rods since it is difficult to tell the quantity of packages remaining on the bracket without an actual count, which is time-consuming. In order to provide suitable inventory control, an actual physical count had to be made of the packages remaining on each bracket. The quantity remaining on a bracket determined the quantity to be ordered. Such inventory control was time-consuming and required a relatively skilled person to make the determination of the quantity to order, so as not to order too much or too little. My earlier U.S. Pat. No. 3,696,937 was directed at the inventory control problem. It is highly desirable that the package supporting bracket rods be firmly coupled to the perforated mounting board and inhibited from swinging in any direction, whether loaded or unloaded, and that they do not unduly stress the peg board. While numerous rod type bracket devices of the above nature have been heretofore available and proposed, they possess numerous drawbacks and disadvantages. They either lack the desired stability and reliability or are multi-element devices, which are expensive, and difficult and inconvenient to use, and of little versitility and adaptability, and otherwise leave much to be desired.

SUMMARY OF THE INVENTION

It is a principal object of the present invention to provide an improved article support device and a method of producing the same.

Another object of the present invention is to provide an improved perforated board mountable bracket for supporting and dispensing pre-packaged articles and an improved method for producing the same.

Still another object of the present invention is to provide an improved perforated board mountable bracket having a counter lever rod support arm for removably suspending prepackaged articles by separably engaging opening in the upper borders of the packages.

A further object of the present invention is to provide a bracket for holding merchandise which allows increments of sold merchandise to be determined quickly to reorder.

A still further object of the present invention is to provide a device and method of the above nature characterized by the simplicity, ruggedness, reliability, low cost and ease and convenience of the application and use of the device and the efficiency and economy of the method.

It is still another object of the present invention to provide an improved ornamental design of a hanger bracket for merchandise.

The above and other objects of the present invention will become apparent from a reading of the following description taken in conjunction with the accompanying drawing which illustrates a preferred embodiment thereof.

In a sense, the present invention contemplates the provision of an improved article support bracket device integrally formed of a single rod and mountable on a peg board, comprising a forwardly directed longitudinal support shank and a pair of opposite traversely outwardly and rearwardly projecting coupling sections integrally formed with and extending from the rear of said shank and terminating in laterally spaced upwardly directed retainer legs.

In the preferred form of the improved bracket, it is formed of a rod of circular cross-section and the shank is provided with a pair of longitudinally spaced upwardly directed index projections between its ends, a transversely flattened upwardly directed leg at its front end and a short upwardly directed leg at its rear end. Each of the coupling sections includes an inner arm projecting laterally outwardly from the upper end of the rear leg and joining a rearwardly projecting medial arm which terminates in an upwardly directed retainer leg.

The improved bracket is advantageously produced by longitudinally vertically medially slitting the rear end portion of a pre-cut rod and then bending the front and rear end portions of the rod upwardly to form a short front leg and a long rear leg, longer than the length of the slit therein. Thereafter, the front leg is transversely flattened, the shank is deformed at spaced points to form shallow upwardly projecting humps, and the opposite split sections formed by the vertical slit are bent laterally outwardly, then rearwardly at points outwardly of the inner ends of said split sections and then upwardly to form the coupling section inner and medial arms and retainer legs.

Further, in accordance with the present invention, there is provided an ornamental design for a hanger bracket for merchandise taking the particular form shown in the accompanying drawings.

The improved bracket device is simple, rugged, reliable, inexpensive, easy and convenient to use and of great versitility and adaptability. The improved method of producing the bracket device is efficient and economical.

DESCRIPTION OF THE PREFERRED EMBODIMENTS

Figures 1, 2, 3, 4:
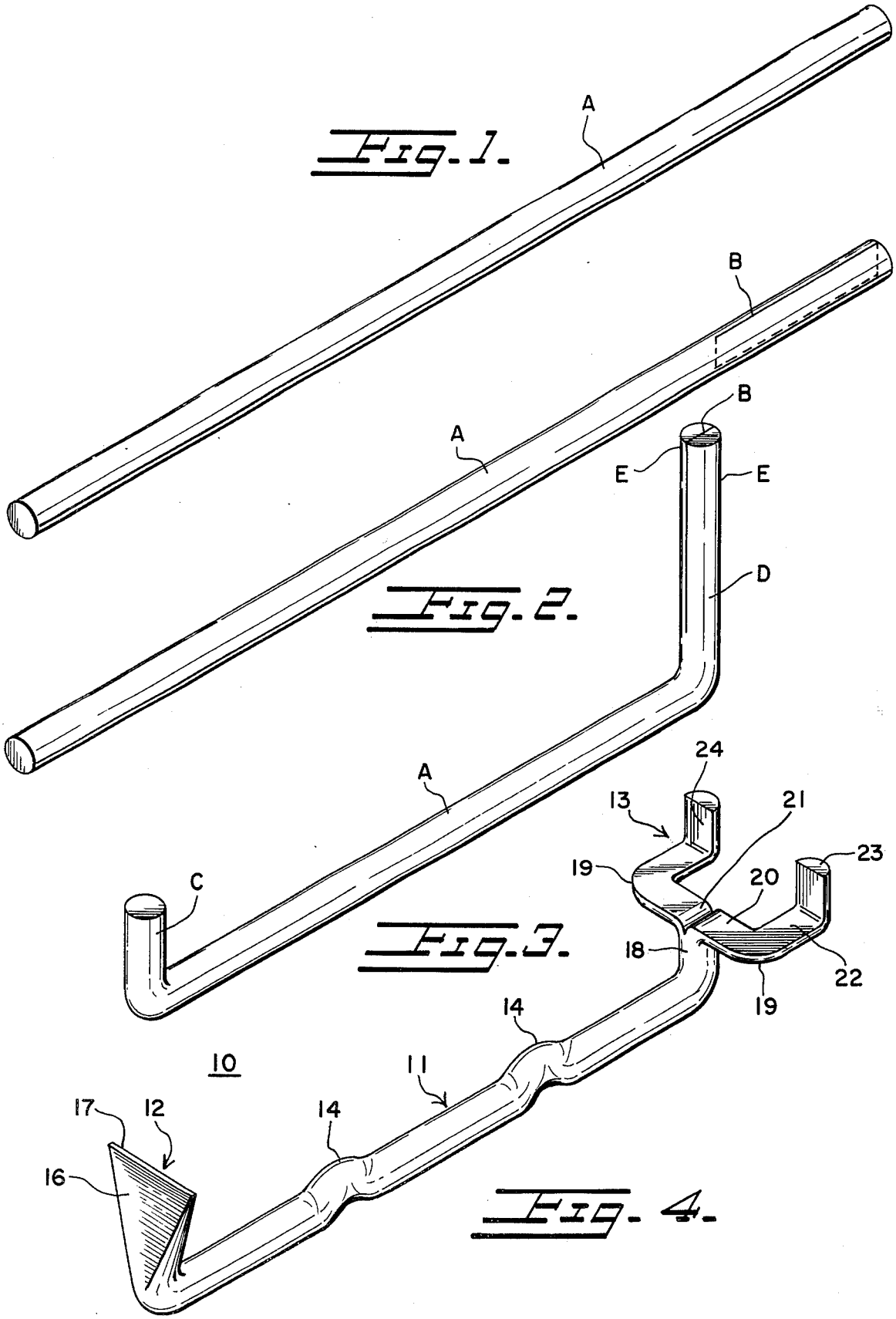
FIG. 1 is a perspective view of a pre-cut length of rod employed in producing the improved bracket according to a preferred embodiment thereof.
FIG. 2 is a perspective view of the unit rod in the next step in the fabrication of the bracket.
FIG. 3 is a perspective view of the unit rod following the next successive fabrication step.
FIG. 4 is a perspective view of the finished improved bracket device.

Referring now to the drawing and particularly FIG. 4 thereof which illustrates one preferred embodiment of the present invention, the reference numeral 10 generally designates the improved bracket device which is formed of a suitably formable steel rod material, or other suitable material, and one or more of which is employed with a conventional perforated board mounted in any desired manner. The backet device 10 is an integral unit and used to suspend article containing packages by slideably releasably engaging holes in the upper borders of the packages and includes a longitudinally extending package supporting elongated shank 11, a label mounting leg 12 at the front end of shank 11 and a peg board coupling section 13 at the rear end of shank 11.

The shank 11 is linear and preferably horizontal and of circular transverse cross-section and has formed between its end a pair of longitudinally spaced upwardly projecting shallow bends or undulations 14 which function as indices to provide information as to the number of packages carried by the shank 11, and hence when to reorder the packaged article for replenishment on the shank.

The label mounting leg 12 projects upwardly from, and is integrally formed with, the front end of the shank 11 and is swaged to provide upwardly outwardly flaring flat front and rear faces 16 which converge upwardly to a top laterally extending apex 17.

The coupling section 13 includes a short bottom leg projecting upwardly from, and integrally formed with, the rear end of shank 11 and is split at the top thereof along a longitudinal diametric plane and shaped to provide opposite similarly shaped coupling portions 19 which are symmetrical to the medial longitudinal plane. Each coupling portion 19 includes a flat-topped inner arm 20 projecting laterally outwardly from and integrally formed with the top of leg 18 and joined thereto by curved knees 21, the opposite inner arms being colinear. A longitudinally rearwardly projecting outer arm 22 is integrally joined to the outer end of each inner arm 20 by outwardly curved elbow portion, the adjacent inner edges of each pair of arms 20 and 22 being substantially perpendicular, the arms 22 being parallel and the arms 20 and 22 being substantially coplanar. Each of the arms 22 terminates at its rear in an integrally formed upwardly projecting coupling leg 23 having a flat front face 24 which is substantially perpendicular to the flat top face of the receptive outer arm 22. The distance between the axis of coupling leg 24 is substantially equal to the horizontal interaxial distance between the apertures of the peg board (not shown) with which the bracket 10 is employed and the arms 20 and 22 are correspondingly dimensioned.

The use and application of the improved bracket device 10 is clear from the above. The bracket device 10 is mounted on a perforated board simply by holding the device vertically with the coupling section 13 lowermost and the leg 24 directed toward the peg board, fully inserting the legs 23 into adjacent holes in the peg board and then permitting the shank 11 to swing downwardly to a horizontal forwardly directed position with the rear faces of arms 20 and leg 18 bearing in the peg board front face. The shank 11 may then be loaded with the pre-packaged articles by sliding the coupling openings therein over leg 12 and rearwardly along the shank 11.

The bracket device 10 is advantageously fabricated from a rod A pre-cut to a pre-determined length which is longitudinally medially or diametrically slit, as at B at the rear portion thereof, as shown in FIG. 2. The rod A is then upwardly bent at its front and rear ends to form a short front leg C and a long rear leg D of greater length than the slit B. The legs C and D are parallel and perpendicular to the main body of rod A and the slit B lies in the vertical medial longitudinal plane thereof. The slit and bent rod is then stamped and shaped by known procedures and equipment to produce the final bracket device 10, the front leg C being swaged to produce leg 12, the split sections E of leg D being spread laterally outwardly and shaped to produce the arms 20 and 22 and legs 23 and the main body of the rod being shaped to form the undulations 14.

It will be appreciated that there is provided, in accordance with the present invention, a system for displaying merchandise carried in bags or mounted on cards on low cost brackets removably mounted on perforated wall board, which provides a ready method of determining the quantity to reorder for inventory control.

The panel surface 16 can carry a code marking, which quickly tells the inventory taker or stock filler, the product carried by the bracket.

While the protuberances 14 are shown upwardly extending, they can also be downwardly extending or having different steps at different levels, such as taught by my earlier patent, 3,696,937. Also, the portions between the protuberances 14, while shown to be about equal in length, could vary depending on the inventory control set-up. Further, more or less protuberances or steps than shown can be used as desired.

It should be understood, of course, that the foregoing disclosure relates only to a preferred embodiment of the invention, and that it is intended to cover all changes and modifications of the examples of the invention herein chosen for the purpose of the disclosure which do not constitute departure from the spirit and scope of the invention as set forth in the appended claims.

Returning now to the ornamental design aspects of the present invention, reference is made to FIGS. 5–8.

Figure 5:
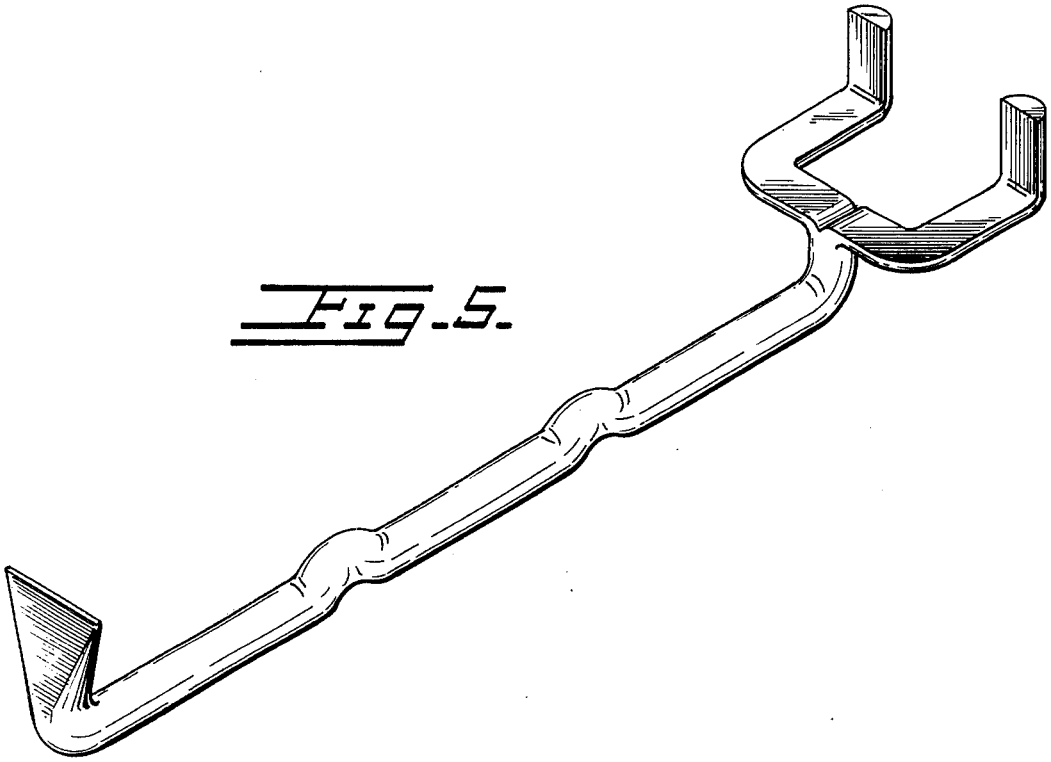
FIG. 5 is a perspective view of the hanger bracket showing the improved ornamental design of the present invention.
Figure 6:
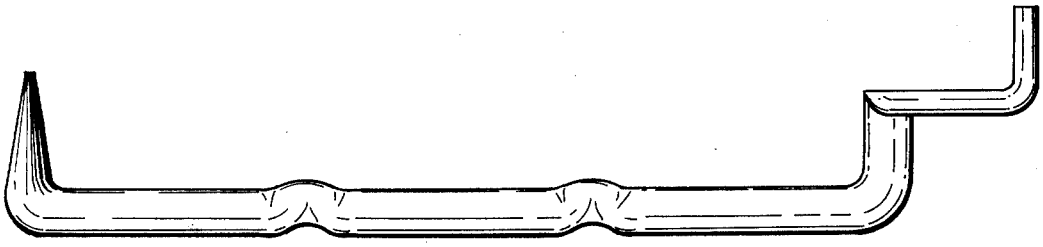
FIG. 6 is a right side elevational view of the device shown in FIG. 5.
Figure 7:
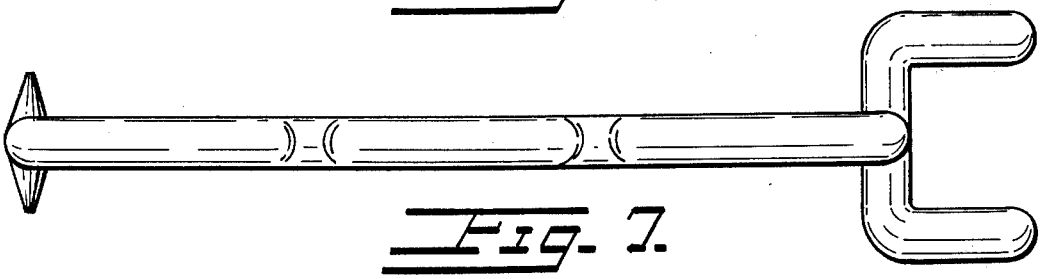
FIG. 7 is a bottom plan view of the device as shown in FIG. 5.

FIG. 5 is a perspective view of the hanger bracket for merchandise showing the new and ornamental design;

FIG. 6 is a side elevational view of the hanger bracket shown in FIG. 5;

FIG. 7 is a bottom plan view of the hanger bracket shown in FIG. 5; and

Figure 8:
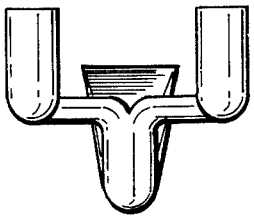
FIG. 8 is a rear elevational view of the device as shown in FIG. 5.

FIG. 8 is a rear elevational view showing the hanger bracket in FIG. 5.

The dominant features of the design reside in the portion shown.

I claim:

1. An article support bracket device integrally formed of a single rod and mountable on a perforated board comprising a forwardly directed longitudinal support shank of circular transverse cross-section terminating at its rear in an upwardly directed base leg, and a pair of opposite transversely outwardly and rearwardly projecting coupling sections integrally formed with and extending from the rear of said shank and terminating in laterally spaced upwardly directed retainer legs, said coupling sections including first arms projecting laterally outwardly from the top end of said base leg and a second arm projecting rearwardly from the outer end of each of said first arms and terminating in one of said retainer legs, said arms and retainer legs being of semicircular transverse cross section, said arms having upwardly facing planar faces and said retainer legs having forwardly facing planar faces.

2. The bracket device of claim 1, wherein said first and second arms are substantially coplanar.

3. The bracket device of claim 1 wherein said shank has longitudinally spaced projections formed thereon.

4. The bracket device of claim 1 wherein said shank terminates at its front end in an upwardly directed flattened leg for the holding of an information-bearing label.

5. An article support bracket device, integrally formed of a single rod and mountable on a perforated board comprising a forwardly directed longitudinal support shank of circular transverse cross-section and having longitudinally spaced projections formed thereon and terminating at its front end in an upwardly directed flattened leg for the holding of an information-bearing label and terminating at its rear end in an upwardly directed base leg, and a pair of opposite transversely projecting coupling sections integrally formed with and extending from the rear of said shank, said coupling sections comprising first arms projecting laterally oppositely from the upper end of said base leg and second arms projecting rearwardly from the outer ends of said first arms and terminating in laterally spaced upwardly directed retainer legs, said arms being of semi-circular cross-section and having upwardly facing planar faces.

6. The bracket device of claim 5 wherein said first and second arms are substantially coplanar.

* * * * *